US011986065B2

(12) United States Patent
De La Poterie et al.

(10) Patent No.: US 11,986,065 B2
(45) Date of Patent: May 21, 2024

(54) SUPPORT FOR ATTACHING AN ACCESSORY FOR DECORATING OR EMBELLISHING A PERSONS BODY

(71) Applicant: LVMH RECHERCHE, Saint Jean de Braye (FR)

(72) Inventors: Valérie De La Poterie, Lailly en Val (FR); Yohann Bichon, Maisons-Alfort (FR); Audrey Destrem, Saintay (FR)

(73) Assignee: LVMH RECHERCHE, Saint Jean de Braye (FR)

( * ) Notice: Subject to any disclaimer, the term of this patent is extended or adjusted under 35 U.S.C. 154(b) by 440 days.

(21) Appl. No.: 17/285,385

(22) PCT Filed: Oct. 15, 2019

(86) PCT No.: PCT/FR2019/052439

§ 371 (c)(1),
(2) Date: Apr. 14, 2021

(87) PCT Pub. No.: WO2020/079363

PCT Pub. Date: Apr. 23, 2020

(65) Prior Publication Data

US 2021/0337943 A1 Nov. 4, 2021

(30) Foreign Application Priority Data

Oct. 16, 2018 (FR) ..... 1859564

(51) Int. Cl.

| | |
|---|---|
| ***A41G 5/02*** | (2006.01) |
| ***A41G 5/00*** | (2006.01) |
| ***A44C 15/00*** | (2006.01) |

(52) U.S. Cl.

CPC ..... *A44C 15/0005* (2013.01); *A41G 5/008* (2013.01); *A41G 5/02* (2013.01); *A44C 15/008* (2013.01)

(58) Field of Classification Search

CPC .. A44C 15/0005; A44C 15/008; A41G 5/008; A41G 5/02; H01F 7/0252

(Continued)

(56) References Cited

U.S. PATENT DOCUMENTS 3,266,500 A * 8/1966 Weld ..... A41G 5/02 132/320
3,516,422 A * 6/1970 Bechtold ..... A41G 5/02 132/53

(Continued)

FOREIGN PATENT DOCUMENTS

EP 1741363 A1 1/2007
JP 3214988 U 2/2018

(Continued)

OTHER PUBLICATIONS

French Search Report issued in corresponding French Application No. 1859564 dated May 2, 2019, 2 pages.

(Continued)

*Primary Examiner* — Jack W Lavinder
(74) *Attorney, Agent, or Firm* — MH2 TECHNOLOGY LAW GROUP, LLP

(57) ABSTRACT

A support (10) for attaching an accessory (30) for decorating or embellishing a person's body, the accessory (30) comprising an object (32) to which a magnetized base (34) is attached, the support (10) comprising a solid substrate (12) having an adhesive back side (14) configured to adhere to a portion of the body (22), and a magnetic compound (16) attached to said substrate (12) and configured to removably retain the accessory (30) on the support (10).

17 Claims, 1 Drawing Sheet

(58) Field of Classification Search
USPC ..... 132/54, 216
See application file for complete search history.

(56) References Cited

U.S. PATENT DOCUMENTS

| | | | | |
|---|---|---|---|---|
| 2019/0261715 | A1* | 8/2019 | Hunter | A61K 8/19 |
| 2019/0289968 | A1* | 9/2019 | Hunter | A44C 15/0065 |
| 2020/0281828 | A1* | 9/2020 | Hunter | A61K 8/26 |
| 2021/0000708 | A1* | 1/2021 | Shen | A61K 8/345 |
| 2022/0079322 | A1* | 3/2022 | Hsu | A61K 8/22 |
| 2023/0081561 | A1* | 3/2023 | Zhang | A41G 5/02 132/53 |
| 2023/0126617 | A1* | 4/2023 | Lucaj | A41G 5/02 132/201 |
| 2023/0240402 | A1* | 8/2023 | McFerran | A61K 8/19 132/216 |

FOREIGN PATENT DOCUMENTS

| | | | |
|---|---|---|---|
| KR | 20120080364 | A | 7/2012 |
| KR | 20160129225 | A | 11/2016 |

OTHER PUBLICATIONS

International Search Report issued in corresponding International Application No. PCT/FR2019/052439 dated Feb. 12, 2020, 2 pages.

* cited by examiner

SUPPORT FOR ATTACHING AN ACCESSORY FOR DECORATING OR EMBELLISHING A PERSONS BODY

CROSS REFERENCE TO RELATED APPLICATIONS

This application is the National Phase of PCT International Application No. PCT/FR2019/052439, filed on Oct. 15, 2019, which claims priority under 35 U.S.C. 119(a) to French Patent Application No. 1859564, filed in France on Oct. 16, 2018, all of which are hereby expressly incorporated by reference into the present application.

The present invention relates to a support for attaching an accessory for decorating or embellishing a person's body, the use of such a support, a kit for decorating or embellishing a person's body and a process for decorating or embellishing a person's body. Such a support can in particular be used for attaching false eyelashes.

PRIOR ART

Consumers who find the application of mascara tricky to achieve, and those who seek an increase in volume and lengthening of the lashes far superior to those that can be achieved with mascara, resort to the application of false eyelashes consisting of artificial lashes mounted on a base that is applied to the eyelid at the edge of the lashes.

The false eyelashes usually used to improve the appearance of the natural lash fringe, in particular the volume, length or density, also allow different color effects to be obtained.

Several methods for attaching false eyelashes are known.

A first method consists in applying an adhesive glue on the eyelid and/or on the base of the false eyelash. However, many consumers prefer to avoid using glues that are known to cause allergies.

Other disadvantages are associated with the use of glue. For example, false eyelashes cannot be reused because, once removed, clumps of glue remain on their base. Furthermore, the application of the glue remains a tricky step that often requires turning to a professional. If the false eyelash was badly adjusted on the eyelid, it is difficult to reposition. It is also complicated to find the right balance between holding to the eyelid over time and ease of removal when the make-up is removed. The lengthening of the attachment time of false eyelashes is obtained at the expense of the ease of removal of the false eyelashes and the removal of the glue left on the eyelid after the false eyelashes have been removed. Some glues are therefore poorly tolerated because they are difficult to remove and cause pain when the false eyelashes come off.

A variant of this method consists in providing an adhesive accessory that provides both the attachment of fiber segments, such as false eyelashes, which are integrated into the accessory, and its own attachment to the eyelid. However, this variant has the following disadvantages: in the event of incorrect application, repositioning of the false eyelashes requires the accessory to be pulled off and reattached to the eyelid, which wears out the adhesive and limits the possibilities of reusing the accessory.

A second method for attaching false eyelashes uses the magnetic attraction of two magnetized false eyelashes. The two false eyelashes, of opposite polarities, are placed on either side of the natural eyelash fringe, and remain in contact until the user separates them manually. However, this application method has its drawbacks. The presence of two false eyelashes on the same fringe of lashes weighs down the eyelid. This is not comfortable for the user, and the make-up result is not always aesthetically pleasing. Moreover, the adjustment of the two false eyelashes depends on the relative position of the magnets on the base of each: if two magnets of opposite polarity are not perfectly aligned at the time of the attachment, the result is not optimal.

These methods, known in the context of false eyelashes, have similar disadvantages for attaching other types of decorative or embellishing accessories to a person's body. Consequently, there is still a need for a process and a tool for attaching a decorative or embellishing accessory, in particular false eyelashes and eye make-up, that is easier and quicker to achieve, easier and quicker to remove, that is aesthetically pleasing, and that allows the accessory to be reused several times.

GENERAL DESCRIPTION OF THE INVENTION

The present invention responds precisely to these needs and relates to a support for attaching an accessory for decorating or embellishing a person's body, the accessory comprising an object to which a magnetized base is attached, the support comprising a solid substrate having an adhesive back side configured to adhere to a portion of the body, and a magnetic compound attached to said substrate and configured to removably retain the accessory on the support.

The solid substrate can be a patch-type element to be deposited on a person's body, the adhesion with the body being ensured by the adhesive back side. Furthermore, thanks to the fact that the support comprises a magnetic compound attached to the substrate, for example deposited on the substrate or integrated into the substrate, it is possible to assemble to the support, in a removable manner, an accessory provided with a magnetized base, for example a magnetized false eyelash. The support thus forms a magnetic patch. The accessory and the support then remain attached to each other thanks to the magnetic attraction between them. In particular, the magnetic compound can be attached to the support so as to removably retain the accessory on the front side of the support. It is understood that the front side is the side of the support opposite the adhesive back side. The terms "front" and "back" are used for brevity to refer to two opposite sides of the support but do not prejudge any absolute orientation.

Removable means that the user can, by grasping the accessory, detach it from the support without separating the support from the body. Thus, nominally, the adhesive force of the adhesive back side on the body can be expected to be greater than the magnetic attraction between the support and the accessory.

As indicated above, the back side is configured to adhere to a portion of the body. This naturally implies dermatological compatibility with said portion of the body and adequate toxicity properties. For example, the back side adhesive may be hypoallergenic.

Thus, the invention makes it possible to avoid both the use of an adhesive and the installation of a heavy means of attachment, such as two fringes of false eyelashes on either side of the natural fringe of eyelashes of the user. The application of an adhesive support is, moreover, particularly simple and does not require any drying time.

The invention also allows the user to easily and quickly remove and reapply the accessory, as long as the support remains in place on the body. It is therefore particularly easy to replace or reposition the accessory, without requiring the support to be moved, which would be repeatedly harmful to the portion of the body concerned.

Finally, the invention allows very easy access to a wide range of make-up effects from the very natural to the very sophisticated, without having to resort to the services of a professional. The accessories can be personalized according to the portion of the body to be embellished by the user and can be reused as many times as the user wishes, independently of the possible loss of adhesiveness of the support.

In some embodiments, the magnetic compound is present in the support in the form of particles, fibers, filaments, a grid or a sheet.

In some embodiments, the magnetic compound comprises a ferrite of formula Fe2O3,MO wherein M represents Fe, Ba, Sr, Mn or Zn.

In some embodiments, the magnetic compound comprises at least one compound selected from mica, aluminum hydroxide, titanium oxide and silicon oxide.

In some embodiments, the magnetic compound is provided on an area of the support having a thickness comprised between 0.1 mm and 2.0 mm, a width comprised between 0.5 mm and 6.0 mm, and a length comprised between 0.5 mm and 50.0 mm. Said length may be less than or equal to 40.0 mm, or even to 30.0 mm. The magnetic compound may be provided on all or part of the solid substrate. In the case where the magnetic compound is provided on the entire solid substrate, which is easier to manufacture and offers compatibility with a wide variety of accessories, the aforementioned dimensions may be those of the solid substrate.

In some embodiments, the substrate comprises at least one compound selected from polyethylene, polyurethane and silicone.

In some embodiments, the substrate comprises a textile layer, for example a fabric, a nonwoven or a natural textile such as a natural silk sheet. The substrate can thus be particularly flexible and strong, so as to conform to the shape of the body at the location where it is intended to be attached.

In some embodiments, the back side further comprises a peelable protective film covering the adhesive back side. This film can protect the adhesive on the back side and be removed from the back side for first use.

In some embodiments, the front side of the support has a decorative pattern, such as a line or gradient of color, or the front side of the support has a decorative shape, such as an eyeliner line shape. Thus, in addition to allowing the attachment of an accessory, the front side itself has an aesthetic function, which improves the make-up result.

In some embodiments, the portion of the body is the skin, the nails, the eyelashes, the lips, the eyelids or the hair.

The invention also relates to a kit for decorating or embellishing a person's body, comprising a support as previously described, and an accessory comprising an object to which a magnetized base is attached. The support may have all or some of the features set forth above.

In some embodiments, the object comprises a rhinestone, a patch, a lace, a jewel, a pearl, a false nail, a false eyebrow, a false eyelash, a tattoo, a design, for example a bird, heart, or word-shaped design.

The invention also relates to a kit for decorating or embellishing a person's body, comprising a solid substrate having an adhesive back side configured to adhere to a portion of the body, a magnetic composition to be applied to said substrate, and an accessory comprising an object to which a magnetized base is attached. By self-applying the magnetic composition to the solid substrate, a user can obtain the above-described support having some or all of the above-stated features. The kit may further comprise means for applying the magnetic composition to the substrate, such as a brush.

The present invention also relates to the use of a support comprising a solid substrate having an adhesive back side configured to adhere to a portion of a person's body, and a magnetic compound attached to said substrate, as a means for attaching a decorative or embellishing accessory to a person's body.

The present invention also relates to a process for decorating or embellishing a person's body, comprising

- a step of depositing, on a portion of the body, a support comprising a solid substrate having an adhesive back side configured to adhere to the portion of the body, and a magnetic compound attached to said substrate, and
- a step of attaching, on the support, an accessory comprising an object to which a magnetized base is attached, the attaching being carried out by magnetic attraction (cooperation) between the magnetized base and the magnetic compound.

The support and/or the accessory can be those described above, having all or part of the features previously stated.

The present invention also relates to a make-up or skincare process implementing a body decoration or embellishment process as described above. The make-up process may comprise the use of at least one support described above, but also the use of additional make-up products. The process of decoration or embellishment using a support and an accessory, according to the invention, may itself be a process of eye make-up when, in particular, the support and/or the accessory alone provides a visual effect which modifies the appearance of the body.

BRIEF DESCRIPTION OF THE DRAWINGS

The invention and its advantages will be better understood upon reading the following detailed description of embodiments given by way of non-limiting examples. This description refers to the appended drawings, in which.

DETAILED DESCRIPTION OF THE INVENTION

Figure 1:
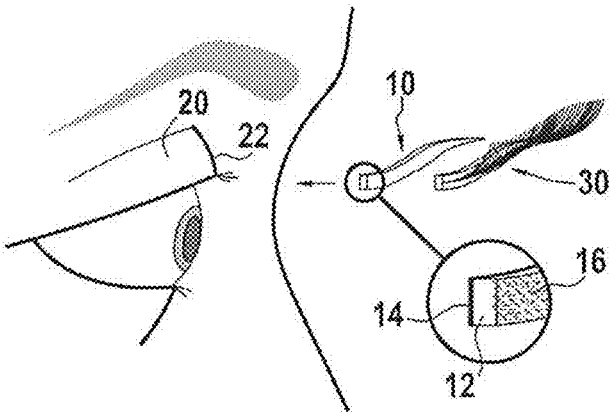
FIG. 1 shows, in cross-section, the structure and application of a decoration or embellishment kit according to an embodiment.
Figure 2:
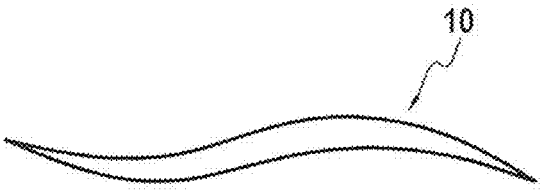
FIG. 2 shows, in front view, a support according to an embodiment.

A kit for decorating or embellishing a person's body will be described with reference to FIGS. 1 to 3. As indicated above, said kit includes a support 10 and an accessory 30 comprising an object to which a magnetized base is attached. For the sake of brevity, the present disclosure describes a false eyelash as an example of an object, but the object may be any decorative or embellishing object, for example a rhinestone, a patch, a lace, a jewel, a pearl, a false nail, a false eyebrow, a tattoo, a design, for example, a bird, heart, or word-shaped design. Similarly, the portion of the body to be decorated here is the eyelid 20, but the kit could be used, with a suitable object, on any body part, in particular the skin, the nails, the eyelashes, the lips or the hair.

The support 10 comprises a solid substrate 12 having an adhesive back side 14 configured to adhere to a portion of the body, in this case the eyelid 20, and a magnetic compound 16 attached to said substrate 12 and configured to removably retain the accessory 30 on the support 10. In this embodiment, the decorating process thus comprises depositing the support 10 containing a magnetic compound 16, at least at the root 22 of the eyelashes, to then attach a magnetized false eyelash 30, which remains in place due to the force of attraction with the magnetic compound 16. These steps could also be performed in reverse order.

According to a first variant, the false eyelash 30 may have a length substantially equal to the length of the person's eyes, and be placed on the eyelid 20 along the entire length of the root 22 of the eyelashes. In this case, the support 10 may be in the form of a line at the root of the eyelashes, as shown in FIG. 2, or an eyeshadow deposited along the root 22 of the eyelashes and on at least one other portion of the eyelid 20. In this variant, a single magnetized false eyelash 30 is placed on the eye.

According to a second variant, the false eyelash 30 is shorter than the length of the eyelid. In this case, one or more false eyelash portions may be attached to the eyelid at the root 22 of the eyelashes, but the false eyelash portions are all positioned on the same side of the natural eyelash fringe.

Solid Substrate

In this embodiment, the solid substrate 12 may comprise one or more films, for example a polyethylene, polyurethane and/or silicone film. The substrate 12 is solid and not liquid or pasty. However, it is useful for the solid substrate 12 to have some flexibility to conform to the shape of the body to be decorated, here the eyelid 20. Such flexibility may be achieved, for example, when the solid substrate 12 comprises a textile layer, such as a fabric, nonwoven or natural textile. The various layers of the solid substrate 12 can be assembled by lamination.

The back side 16 of the solid substrate 12, intended to be attached to the body, may be adhesive, for example partially or fully covered with a layer of adhesive ensuring attachment with the body. The selected adhesive may be repositionable to allow multiple uses of the solid substrate 12. Furthermore, the chosen adhesive is, for example, hypoallergenic or at least compatible with extended contact with the body. The support 10 may comprise a peelable protective film covering, prior to use, the adhesive back side 14, or at least the adhesive portions of said back side 14.

The solid substrate 12 can be cut to match the desired shape of the support 10, as mentioned above.

The solid substrate 12 may have a thickness of less than or equal to 2 mm, preferably 1 mm, more preferably 0.5 mm, more preferably 0.4 mm, more preferably 0.3 mm. Thus, the solid substrate 12 maintains a good flexibility that does not cause any discomfort during body movements.

Solid substrates of this type, without the magnetic compound described below, are known per se and for example currently marketed, as will be detailed below. The person skilled in the art will know how to choose the structure and materials of the substrate according to the desired texture, dimensions and flexibility.

Magnetic Compound

A magnetic compound 16 is attached to the solid substrate 12. In order to maximize the magnetic character of the support 10, the magnetic compound is preferably attached to the solid substrate 12 on a side of the solid substrate 12 opposite the adhesive back side. The magnetic compound 16 may be at least partially visible on the support 10, for example when it participates in the pigmentation or decoration of the support 10, or concealed, such as when it is embedded in the solid substrate 12.

The magnetic compound 16 may be provided on an area of the support having a thickness comprised between 0.1 mm and 2.0 mm, a width comprised between 0.5 mm and 6.0 mm, and a length comprised between 0.5 mm and 50.0 mm. Said area, which allows the attachment of a magnet of the desired accessory, is then thin enough to be discrete, while offering a sufficient attachment surface.

Thus, the magnetic compound 16 may be present on the entire support 10 or on a restricted area of the support 10. It is sufficient that the magnetic compound 16 is present at least at the locations intended to face the magnet(s) of the accessory 30. However, a magnetic compound 16 present at several locations, and at the extreme on the entire support 10, allows for the adoption of various accessories 30 without changing the support 10.

The magnetic compound 16 is, in any event, present in an amount sufficient to provide magnetic attraction to hold a magnetized-base accessory, typically a false eyelash 30 having the features described below.

The magnetic compound 16 may be present in the support 10 in various forms, such as in the form of particles, fibers, filaments, a grid or a sheet. The use of particles, illustrated schematically in FIG. 1, allows the magnetic compound 16 to be homogeneously distributed on the substrate 12 without weighing it down.

The preferred magnetic particles are less than 150 microns in size, preferably less than 100 microns, and more preferably less than 60 microns.

"Size" means the average particle size, D50, D90, D95, D100 or any other definition known to the skilled person. Size can also be the largest dimension of one of the magnetic particles.

The particle size can be measured by any microscopy method known to the skilled person such as laser microscopy.

In an embodiment, the magnetic particles may be characterized by a D50 value comprised between 0.05 and 0.3 micron, and/or by a D90 value of less than 5 microns.

The features detailed below are presented with the example of magnetic particles, but apply mutatis mutandis to other forms of magnetic compounds.

The magnetic particles comprise a ferrite of formula Fe2O3,MO wherein M represents Fe, Ba, Sr, Mn or Zn. They may comprise, in addition to the ferrite, at least one other mineral compound selected, for example, from mica, aluminum hydroxide, titanium oxide and silicon oxide.

The magnetic particles preferably comprise more than 90% by mass ferrite, which ferrite may be coated with an inorganic coating, for example an inorganic coating comprising one of the compounds described above. Alternatively, the magnetic particles may comprise an inorganic support coated with ferrite, for example an inorganic support comprising one of the compounds described above.

In a particular embodiment, M represents Fe and the ferrite is an iron oxide of formula Fe3O4. In this embodiment, the magnetic particles may have an INCI name of CI 77499 or IRON OXIDES.

The magnetic particles can be selected from:

particles comprising Fe3O4 coated with silica, particles comprising Fe3O4 of octagonal shape with a D50 value ranging from 1 to 2 microns, particles comprising Fe3O4 and traces of other mineral oxides, the particles having a D50 of the order of 0.10 to 0.20 micron, the magnetite particles having for example a D80 of less than 100 microns, and particles comprising a mica support and a Fe3O4 coating, the particles having a size comprised between 10 and 60 microns.

The magnetic particles can be colored or not.

According to an embodiment, the magnetic particles may be deposited on the solid substrate 12 by first being embedded in a composition so as to obtain a magnetic composition, the magnetic composition then being deposited on the substrate 12, typically on the front side opposite the adhesive back side 14. For the magnetic compositions described below, the deposition can be done in one pass; depending on the magnetic composition, several passes may be necessary for the support to contain enough magnetic compound 16 to allow the accessory 30 to hold well. After drying, the support 10 is obtained, comprising the solid substrate 12 and the magnetic compound 16 attached on said substrate.

The resulting support 10 can have a thickness comprised between 0.1 mm and 2.0 mm. Its thickness can be measured by any method known to the skilled person, for example with an Electronic Outside Micrometer from the firm Schut.

The magnetic composition may comprise from 20% to 99% by mass of magnetic particles comprising more than 95% by mass of a ferrite of formula Fe2O3,MO wherein M represents Fe, Ba, Sr, Mn or Zn.

The composition may comprise, for example, an amount of magnetic particles greater than a value selected from 20%, 25%, 30%, 35%, 40%, 45%, 50%, 55%, 60%, 65%, 70%, 75%, 80%, 85%, 90%, and less than a value selected from 99%, 95%, 90%, 85%, 80%, 75%, 70%, 65%, 60%, 55%, 50%, 45%, 40%, 35%, 30%, and 25%, with the percentages being expressed by mass based on the mass of the composition.

The magnetic composition, indeed the magnetic compound, may be coated with a protective varnish, provided that the varnish does not render the magnetic compound unsuitable for retaining the accessory on the support.

Galenic

The aforementioned magnetic composition may have different galenic forms. For example, it may be in the form of an aqueous dispersion, an anhydrous dispersion, a water-in-oil emulsion or an oil-in-water emulsion. Thus, the magnetic particles may be dispersed in a liquid or solid fat phase, or in an aqueous phase. The magnetic composition can have any consistency, for example fluid, pasty or solid.

According to a first embodiment, the composition is liquid in the form of a dispersion of magnetic particles in water.

According to a second embodiment, the composition is an anhydrous solid composition containing waxes obtained by hot casting, for example a pencil.

According to a third embodiment, the composition is a powdered anhydrous solid composition comprising fillers that have been compacted with a fatty binder in the presence of magnetic particles.

It is preferred that the composition not be an anhydrous composition comprising too much oil, which risks reducing the attractive force between the magnetic composition and the magnetized false eyelashes.

The magnetic composition may appear colored or colorless to the user, so that a deposit of the magnetic composition on the substrate 12 may appear colored or colorless.

When the composition is fluid, its viscosity measured at a room temperature of 20° C. or 25° C. can be between 3 000 and 12 000 cPs. This viscosity can be measured with a Rheolab QC viscometer (Anton Paar) equipped with Rheoplus software using a suitable spindle and measurement time (for example ST22-4V 4-blade spindle, at 100 rpm, for 3 min). Prior to the measurement, the composition of the invention will have been placed in a 120 ml jar.

The percentage of deviation of the measurements, which are carried out every 6 seconds, is measured to check that the spindle is well chosen. The value of the viscosity of the composition is equal, according to this protocol, to the average of the last fifteen measurements carried out by the apparatus during the measurement time indicated above.

According to a variant, the magnetic composition may be fluid, in the form of a dispersion of the magnetic particles in water. A particular fluid composition is an aqueous dispersion containing less than 5% by mass of oil. The majority compound in the aqueous dispersion is preferably water. The composition may comprise from 25% to 80% water and optionally a dispersing agent for said magnetic particles in an amount sufficient to ensure homogeneity and stability of the composition. It may also comprise from 3% to 15% by mass of a polyol selected from glycerine, butylene glycol, pentylene glycol and mixtures thereof. Finally, the composition may further comprise at least one polymer, soluble or dispersed in water, for example a polyvinyl alcohol, a polyurethane, a polyacrylate or a mixture thereof. In a particular embodiment, the composition is a black liquid eyeliner containing from 0.2% to 0.6% by mass of a gelling polymer, from 5% to 20% by mass of a film-forming polymer, from 20% to 55% by mass of magnetic particles, from 3% to 15% by mass of at least one polyol, and from 25% to 70% by mass of water. The gelling polymer may have film-forming properties and the film-forming polymer may have gelling properties.

According to another variant, the magnetic composition is an anhydrous molded, cast or pressed composition comprising, in addition to the magnetic particles, powdered compounds such as fillers or pigments. In this case, the composition may contain at least one fatty binder compound, which gives cohesion to the mixture of magnetic particles and powders. The fatty binding compound can be oily, pasty or waxy in consistency. The person skilled in the art will know how to choose the nature and adapt the amount of the fatty compound according to the desired texture.

The pigments can be selected from manganese violet, ultramarine blue, hydrated chromium oxide, ferric blue, carbon black, lacquers (consisting of a water-soluble dye grafted onto a titanium dioxide support), and pearlescent pigments (comprising a mica and/or titanium oxide support)

The fillers may be selected in particular from talc, micas, kaolin, metal soaps derived from organic carboxylic acids having from 8 to 22 carbon atoms, zinc oxides, titanium oxides, calcium carbonate, magnesium carbonate, magnesium hydrocarbonate, silica, glass beads, ceramic beads, crosslinked or non-crosslinked starches, synthetic polymer powders, crosslinked or not, spheronized or not, foamed or not, such as polyethylene, polyester, polyamide, poly(meth) acylate, polyurethane, divinylbenzene-crosslinked polystyrene, silicone resin such as silsesquioxanes, or tetrafluoroethylene powders.

A magnetic composition may be in the form of a pressed powder comprising magnetic particles, fillers and pigments. The sum of the magnetic particle content, the filler content and the pigment content is preferably from 50% to 99% by mass, for example from 70% to 90% by mass, of the mass of the composition. The pressed powder may also contain from 5% to 30% by mass of a fatty binder compound.

The composition containing magnetic particles has the function of attaching the magnetized false eyelash to the support, and optionally the function of coloring the support.

Magnetized False Eyelashes

Figure 3:
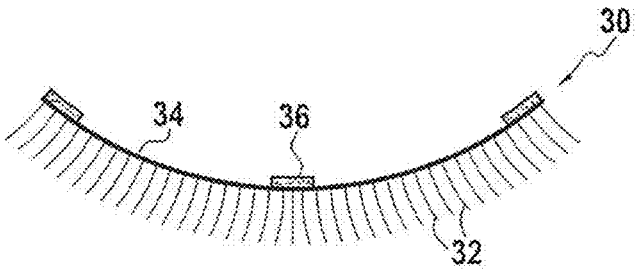
FIG. 3 shows, schematically, an example of an accessory according to an embodiment.

FIG. 3 illustrates an example of a false eyelash 30 according to an embodiment.

The false eyelash clings to the support 10 due to the attractive force between the magnetized base 34 and the magnetic compound 16.

The magnetized base 34 of the false eyelash 30 comprises a single magnet or at least two magnets, or even three magnets 36 as shown in FIG. 3, or even four or more magnets. The false eyelash 30 thus comprises one or more magnets 36 whose number, size (in particular length), and arrangement on the base are adapted by the person skilled in the art according to the shape of the false eyelash (degree of curvature, mass, length).

According to a first variant, the base 34 of the false eyelash comprises a single magnet whose length is equal to the length of the base. When the false eyelash is of short length, it may comprise only one magnet of length less than the length of the base and preferably located in the center thereof.

According to a second variant, illustrated in FIG. 3, the base 34 includes a plurality of magnets 36 spaced at regular intervals across the base so as to achieve satisfactory adhesion. The base 34 may include two magnets 36 located at each of its ends, optionally with a magnet 36 located on an intermediate portion of the base 34.

According to a third variant, the base of the false eyelash is made of a magnet around which the eyelashes are wrapped.

The lashes 32 of the false eyelashes can be made of natural or synthetic material.

The base 34 of the false eyelash can be selected or cut to have a length equal to that of the person's eyelid.

The base of the false eyelash can also be much smaller than the length of the eyelid, in which case reference is made to a false eyelash portion. The false eyelash portions can be half fringes or individual lashes. The support 10 can therefore be attached to the entire length of the root 22 of the eyelashes or be attached to only a portion of the root 22 of the eyelashes.

The false eyelash portion can, for example, bring a color effect on certain areas of the natural fringe or increase the density of the person's lashes on a particular area. In this case, one or more portions of false eyelash can be attached to the same side of the natural lash fringe. The false eyelash can enhance the look, open the eyes, increase the density of the lashes, lengthen the lashes or color them.

In a particular embodiment of the invention, the magnetized base 34 of the false eyelash comprises at least one magnet 36 whose largest dimension is comprised between 0.1 and 6 mm.

These magnets 36 may be substantially parallelepipedic in shape and have a thickness comprised between 0.1 and 0.5 mm, or may be substantially cylindrical in shape, such as a wire, and have a diameter comprised between 0.1 and 1.0 mm.

According to an embodiment, the magnet 36 has a thickness comprised between 0.1 and 2.0 mm, a width comprised between 0.5 and 6.0 mm, and a length comprised between 0.5 and 6.0 mm.

The magnet 36 may be made of a material selected from neodymium, steel, magnetite, ferrite, aluminum-nickel-cobalt alloy, samarium-cobalt alloy, or hematite.

For example, the magnet 36 emits a magnetic field with a strength comprised between 500 gauss and 2 500 gauss.

According to a particular embodiment, the base 34 of the false eyelash comprises a single magnet 36 at each of its ends.

According to another embodiment, the false eyelash 30 comprises a single magnet 36 having a length equal to that of the base 34 of the false eyelash.

The false eyelash 30 may comprise an eyelash fringe 32 made of synthetic fibers and/or natural eyelashes that may be identical or different in length, color and/or thickness. The false eyelash 30 may provide different make-up results, depending on the nature of the fringe. For example, the material, shape, density, color, length, and curl of the fibers or lashes of the false eyelash can vary to create a natural, dense, long, curved, black, colored, or pearlescent effect. Some of the fibers may in feather form or carry rhinestones.

The eyelash fringe 32 can have a variable length according to the desired effect. The false eyelash can be customized to fit the length and shape of the person's eyes.

In an embodiment, the process of the invention may comprise, prior to the steps of depositing and attaching, a step of choosing, by the user, the false eyelash from a set comprising several false eyelashes, and a step of choosing, by the user, a attaching support from a set of several different attaching supports, the choices being guided by the shape of the user's eyes and by the make-up effect sought by the user, said attachment supports of the set of supports being independently of each other conforming to one of the supports 10 described above, and said false eyelashes of the set of false eyelashes being independently of each other conforming to one of the false eyelashes 30 described above.

In the context of this embodiment, the set of false eyelashes 30 may be offered for sale in a single package, the set of supports 10 may be offered for sale in a single package as well. In another variant, a kit comprising at least one false eyelash 30 and at least one support 10, or even comprising at least two false eyelashes 30 and at least two supports 10, one for the left eye and one for the right eye, may be offered for sale in a single package.

In order to better guide her choice, the user will be able, at the point of sale or at home, to carry out a digital simulation of the aesthetic result obtained with a given pair of false eyelashes and a given support. This simulation can be obtained from an image bank or drawings. The user can also use an augmented reality application and simulate the rendering from one of her photographs. Such a simulation can possibly allow the support and/or the false eyelash to be personalized to the shape of the user's eyelid, for example to the length of the base of the lashes, and to the desired aesthetic result.

The invention is further illustrated by the following example embodiments.

Examples 1 to 10: Manufacture of Patches Comprising Magnetic Particles

Pairs of magnetizable self-adhesive supports (patches) were prepared by applying a liquid composition containing water to the non-adhesive surface of a textile material forming the upper part of an eyeliner-shaped patch sold by the company Marbella.

Several liquid compositions were prepared. The ingredients used in the manufacture of these compositions and their proportions are given in Tables 1 and 2 below. The percentages are by mass.

Delicate, Natural and Hollywood reference patches were used.

Each liquid composition was applied manually in one pass, with a conventional felt-tip applicator, on each of the three patches, then the whole was left to dry for a few minutes at 25° C., until the film was dry to the touch.

TABLE 1

| Chemical or INCI name | Trade name | Ex. 1 | Ex. 2 | Ex. 3 | Ex. 4 | Ex. 5 | Ex. 6 | Ex. 7 |
|---|---|---|---|---|---|---|---|---|
| Xanthan gum | Rhodicare XC | 0.5 | 0.5 | 0.5 | 0.3 | 0.3 | 0.5 | 0.5 |
| Polyvinyl alcohol | Selvol Ultalux FP | 10 | 10 | 10 | 8 | 7 | 10 | 10 |
| Acrylate copolymer | Covacryl A15WP | 22 | 22 | 22 | 15 | 10 | 22 | 22 |
| Iron oxide | C337001 Sunpuro Black Iron oxide | 30 | | | | | | |
| Iron oxide and silica | Sympholigth BW | | 30 | | 40 | 50 | | |
| Iron oxide | Tarox Iron Oxide | | | 30 | | | | |
| Sand | Microzest 50 Magnetite | | | | | | 30 | |
| Iron oxides, mica and titanium dioxide | Colorona Mica black | | | | | | | 30 |
| Glycerine | | 4.5 | 4.5 | 4.5 | 2 | 1.5 | 4.5 | 4.5 |
| Butylene glycol | | 4.5 | 4.5 | 4.5 | 2 | 1.5 | 4.5 | 4.5 |
| Pentylene glycol | | 3 | 3 | 3 | 3 | 3 | 3 | 3 |
| Phenoxyethanol | | 0.25 | 0.25 | 0.25 | 0.25 | 0.25 | 0.25 | 0.25 |
| Water | | q.s. 100 | q.s. 100 | q.s. 100 | q.s. 100 | q.s. 100 | q.s. 100 | q.s. 100 |

TABLE 2

| EXAMPLES Chemical or INCI name | Trade name | Ex. 8 | Ex. 9 | Ex. 10 |
|---|---|---|---|---|
| Xanthan gum | Rhodicare XC | 0.3 | 0.5 | 0.5 |
| Polyvinyl alcohol | Selvol Ultalux FP | — | 5 | 3 |
| Acrylate copolymer | Syntran PE 5760 302-7 | — | — | 29 |
| Polyurethane-35 | Baycusan C1004 | 17 | 27 | — |
| Iron oxide | C33-7001 Sunpuro Black Iron oxide | — | | 30 |
| Iron oxide and silica | Sympholigth BW | 50 | — | |
| Iron oxide | Tarox Iron Oxide | — | 30 | — |
| Glycerine | | 1.5 | 4.5 | 9 |
| Butylene glycol | | 1.5 | 4.5 | — |
| Pentylene glycol | | 3 | 3 | 3 |
| Phenoxyethanol | | 0.25 | 0.25 | 0.25 |
| Water | | q.s. 100 | q.s. 100 | q.s. 100 |

Example 11: Patch Containing Magnetic Particles and Performance of Holding Magnetized False Eyelashes on the Eyelids Patch Manufacture and Thickness Pairs of magnetizable patches were prepared according to the same method as described in the previous examples using a fluid composition described in Table 3, and a commercial reference Marbella Eyeliner Natural eyeliner adhesive base. Percentages are by mass.

TABLE 3

| EXAMPLE Chemical or INCI name | Trade name | Ex. 11 |
|---|---|---|
| Xanthan gum | Rhodicare XC | 0.5 |
| Polyvinyl alcohol | Selvol Ultalux FP | 3 |
| Polyurethane-35 | Baycusan C1004 [1] | 19.2 |
| Iron oxide | C33-7001 Sunpuro Black Iron oxide | 40 |
| Glycerine | | 4.5 |
| Butylene glycol | | 4.5 |
| Pentylene glycol | | 3 |
| Phenoxyethanol | | 0.25 |
| Water | | q.s. 100 |

[1] Baycusan C1004 is a polymer dispersion in water.

The thickness of the adhesive base and the thickness of the magnetizable patch comprising the adhesive base coated with the magnetizable composition of Example 11 when dry were measured with an Electronic Outside Micrometer® from Schut. The average of four measurements is given in Table 4.

TABLE 4

| | |
|---|---|
| Thickness of the solid substrate (mm) | 0.161 (±0.003) |
| Thickness of the magnetizable patch (mm) | 0.195 (±0.008) |

Evaluation of the Hold of Magnetized False Eyelashes on Patches

Volunteers evaluated the hold of magnetized false eyelashes using these magnetizable patches. They applied a patch to the upper lash line of each eyelid, and then placed on each patch a Magnetic Eyelashes CLIC LASH—Natural Look® (1620 gauss strength) sold by SPITZER & HELMLE UG.

The hold of the false eyelashes to the patch was good. The eyelashes could easily be repositioned on the eyelid and stayed in place on the eyelids all day.

Although the present description refers to specific example embodiments, modifications may be made to these examples without departing from the general scope of the invention as defined by the claims. In particular, individual features of the various illustrated/mentioned embodiments may be combined in additional embodiments. Consequently, the description and drawings should be considered in an illustrative rather than restrictive sense.

The invention claimed is:

1. A support for attaching an accessory for decorating or embellishing a person's body, the accessory comprising an object to which a magnetized base is attached, the support comprising a solid substrate having an adhesive back side configured to adhere to a portion of the person's body, and a magnetic compound attached to said solid substrate and configured to removably retain the accessory on the support, wherein the magnetic compound comprises a ferrite of formula $Fe_2O_3 \cdot MO$ wherein M represents Fe, Ba, Sr, Mn, or Zn.

2. The support as claimed in claim 1, wherein the magnetic compound is present in the support in the form of particles, fibers, filaments, a grid, or a sheet.

3. The support as claimed in claim 1, wherein the magnetic compound comprises at least one compound selected from mica, aluminum hydroxide, titanium oxide, and silicon oxide.

4. The support as claimed in claim 1, wherein the magnetic compound is provided on an area of the support having a thickness comprised between 0.1 mm and 2.0 mm, a width comprised between 0.5 mm and 6.0 mm, and a length comprised between 0.5 mm and 50.0 mm.

5. The support as claimed in claim 1, wherein the solid substrate comprises at least one compound selected from polyethylene, polyurethane, and silicone.

6. The support as claimed in claim 1, wherein the solid substrate comprises a textile layer.

7. The support of claim 6, wherein the textile layer comprises one or more of a fabric, a nonwoven, and a natural textile.

8. The support as claimed in claim 1, further comprising a peelable protective film covering the adhesive back side.

9. The support as claimed in claim 1, wherein a front side of the support has a decorative pattern or the front side of the support has a decorative shape.

10. The support of claim 9, wherein the decorative pattern comprises one or more of a line gradient and a color gradient.

11. The support as claimed in claim 1, wherein the portion of the person's body is one of skin, nails, eyelashes, lips, eyelids and hair.

12. A kit for decorating or embellishing a person's body, comprising a support as claimed in claim 1, and an accessory comprising an object to which a magnetized base is attached.

13. The kit as claimed in claim 12, wherein the object comprises one or more of a rhinestone, a patch, a lace, a jewel, a pearl, a false nail, a false eyebrow, a false eyelash, a tattoo, and a design.

14. The kit of claim 13, wherein the design comprises one or more of a bird, a heart, and a word.

15. A kit for decorating or embellishing a person's body, comprising a solid substrate having an adhesive back side configured to adhere to a portion of the body, a magnetic composition to be applied to said solid substrate, and an accessory comprising an object to which a magnetized base is attached.

16. A process for decorating or embellishing a person's body, comprising a step of depositing, on a portion of the person's body, a support comprising a solid substrate having an adhesive back side configured to adhere to the portion of the person's body, and a magnetic compound attached to said solid substrate, wherein the magnetic compound comprises a ferrite of formula $Fe_2O_3 \cdot MO$ wherein M represents Fe, Ba, Sr, Mn, or Zn, and a step of attaching, on the support, an accessory comprising an object to which a magnetized base is attached, the step of attaching being carried out by cooperation between the magnetized base and the magnetic compound.

17. A make-up or skincare process implementing a body decoration or embellishment process as claimed in claim 16.

* * * * *